US008807027B2

(12) United States Patent
Krueger et al.

(10) Patent No.: US 8,807,027 B2
(45) Date of Patent: Aug. 19, 2014

(54) APPARATUS FOR METERING PRINTING INK AND PRINTING PRESS HAVING THE APPARATUS

(75) Inventors: Sebastian Krueger, Wilhelmsfeld (DE); Bernhard Roskosch, Wiesloch (DE); Michael Voge, Malsch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 295 days.

(21) Appl. No.: 12/902,249

(22) Filed: Oct. 12, 2010

(65) Prior Publication Data

US 2011/0100242 A1 May 5, 2011

(30) Foreign Application Priority Data

Oct. 9, 2009 (DE) ..... 10 2009 049 207

(51) Int. Cl.
*B41F 13/04* (2006.01)
*B41F 13/02* (2006.01)

(52) U.S. Cl.
USPC ..... 101/364; 101/350.1; 101/365

(58) Field of Classification Search
USPC ..... 101/364, 350.1, 349.1, 348, 351.3, 101/352.09
See application file for complete search history.

(56) References Cited

U.S. PATENT DOCUMENTS

| | | | | |
|---|---|---|---|---|
| 2,948,217 | A | | 8/1960 | Witt |
| 3,566,787 | A | * | 3/1971 | Moos ..... 101/363 |
| 4,391,192 | A | | 7/1983 | Wieland |
| 4,502,386 | A | | 3/1985 | Cappel et al. |
| 4,611,538 | A | | 9/1986 | Simeth |
| 4,624,183 | A | | 11/1986 | Kunkel et al. |
| 5,113,762 | A | | 5/1992 | Abendroth et al. |
| 5,289,772 | A | | 3/1994 | Kohara et al. |
| 7,389,728 | B2 | | 6/2008 | Hieronymus et al. |

FOREIGN PATENT DOCUMENTS

| | | | |
|---|---|---|---|
| DE | 3033998 | A1 | 4/1982 |
| DE | 3218045 | A1 | 11/1983 |
| DE | 3400831 | A1 | 7/1985 |
| DE | 3427909 | A1 | 2/1986 |
| DE | 4012949 | C1 | 3/1991 |
| EP | 0533308 | A1 | 3/1993 |
| JP | S5777575 | A | 5/1982 |
| JP | S62236741 | A | 10/1987 |
| JP | H04224956 | A | 8/1992 |

OTHER PUBLICATIONS

German Search Report dated Jun. 30, 2010.

* cited by examiner

*Primary Examiner* — Daniel J Colilla
*Assistant Examiner* — Leo T Hinze
(74) *Attorney, Agent, or Firm* — Laurence A. Greenberg; Werner H. Stemer; Ralph E. Locher

(57) ABSTRACT

An apparatus for metering printing ink includes an ink fountain roller, an ink fountain and a mounting for the ink fountain. The mounting permits an adjustment of the ink fountain relative to the ink fountain roller. The mounting has at least one elastic element for generating a holding force. The mounting is configured in such a way that a force flux which results from the holding force deflects the ink fountain roller in such a way that its longitudinal outer contour is adapted to the longitudinal outer contour of the ink fountain. A printing press having the apparatus is also provided.

2 Claims, 5 Drawing Sheets

APPARATUS FOR METERING PRINTING INK AND PRINTING PRESS HAVING THE APPARATUS

CROSS-REFERENCE TO RELATED APPLICATION

This application claims the priority, under 35 U.S.C. §119, of German Patent Application DE 10 2009 049 207.0, filed Oct. 9, 2009; the prior application is herewith incorporated by reference in its entirety.

BACKGROUND OF THE INVENTION

Field of the Invention

The present invention relates to an apparatus for metering printing ink, including an ink fountain roller, an ink fountain and a mounting for the ink fountain. The mounting permits an adjustment of the ink fountain relative to the ink fountain roller and the mounting has at least one elastic element for generating a holding force. The invention also relates to a printing press having the apparatus.

Such apparatuses are subjected to complex loadings during printing operation, as a consequence of which the ink fountain and the ink fountain roller deflect. Various measures have already been proposed to avoid or compensate for the disruptive deflection.

It is proposed in German Published, Non-Prosecuted Patent Application DE 30 33 998 A1, corresponding to U.S. Pat. No. 4,391,192, to shorten the deflection length by fastening the ink fountain to the journals of the ink fountain roller. That fastening takes place through the use of a drawing device or traction mechanism, for example wire cables, which wrap around bearing rings that are mounted on the journals of the ink fountain roller. In order to tension the drawing device or traction mechanism, there are over-center tensioning mechanisms with dead centers, beyond which tensioning levers of the over-center tensioning mechanisms can be adjusted. It is to be assumed that the ink fountain is supported in some way, as a result of which a spacing that is required between the ink fountain and the ink fountain roller is fixed in the operating position of the ink fountain.

German Published, Non-Prosecuted Patent Application DE 34 27 909 A1, corresponding to U.S. Pat. No. 4,624,183, describes an apparatus having an ink fountain which is equipped with rollers that bear against the circumferential surface of the ink fountain roller, in order to support the ink fountain. Forces for pressing the rollers onto the ink fountain roller can be generated by springs according to one mentioned variant, and can be generated through the use of a tensioning lever which is moved past a dead center according to another mentioned variant.

German Published, Non-Prosecuted Patent Application DE 32 18 045 A1, corresponding to U.S. Pat. No. 4,502,386; German Patent DE 40 12 949 01, corresponding to U.S. Pat. No. 5,113,762; and European Patent Application EP 0 533 308 A1, corresponding to U.S. Pat. No. 5,289,772, describe further prior art. In the known apparatuses, the loadings which occur during printing operation and the resulting deflecting behavior are only taken into consideration to an insufficient extent. As a consequence, the occurrence of so-called edge supports or loadings cannot be avoided completely. Edge supports or loadings are those metering elements of the ink fountain having metering edges which are oblique in an undesired manner with respect to the generatrix of the ink fountain roller as a consequence of the deflection.

The so-called zero position of a respective metering element is defined by its set minimum spacing relative to the ink fountain roller. In the case of a satisfactorily set metering element, that spacing is approximately 5 μm. If the mentioned oblique position of the metering element is present, then only one edge of the metering element, for example the right hand edge, maintains the required spacing of 5 μm and the other edge, the left hand edge in the given example, is situated at a spacing of 15 μm relative to the ink fountain roller. That has the result that the ink layer thickness, which is averaged over the width of the metering element, is doubled. If the machine operator attempts to compensate for that effect by adjusting the metering element, it results in a metallic contact between the metering element and the ink fountain roller, and therefore results in wear which leads to machine damage.

SUMMARY OF THE INVENTION

It is accordingly an object of the invention to provide an apparatus for metering printing ink and a printing press having the apparatus, which overcome the hereinafore-mentioned disadvantages of the heretofore-known devices of this general type and in which a loading-induced contact of metering elements of an ink fountain with an ink fountain roller and resultant wear are reliably avoided.

With the foregoing and other objects in view there is provided, in accordance with the invention, an apparatus for metering printing ink. The apparatus comprises an ink fountain roller having a longitudinal outer contour, an ink fountain having a longitudinal outer contour and a mounting for the ink fountain. The mounting permits an adjustment of the ink fountain relative to the ink fountain roller. The mounting has at least one elastic element for generating a holding force. The mounting is configured in such a way that a force flux resulting from the holding force deflects the ink fountain roller so as to adapt the longitudinal outer contour of the ink fountain roller to the longitudinal outer contour of the ink fountain.

In the apparatus according to the invention, so-called edge supports or loadings are reliably avoided. The edge supports or loadings are those metering elements of the ink fountain in which the metering edges thereof are oblique in an undesired manner relative to the generatrix of the ink fountain roller. The avoidance of the edge supports or loadings plays practically no role in the case of ink fountains having metering elements which are metering cylinders or eccentrics that are pressed toward the ink fountain roller by springs. The avoidance of the edge loadings is particularly important and advantageous in the case of those ink fountains having metering elements which are configured as metering slides, tongues or levers and are not pressed against the ink fountain roller in each case by a spring. The ink fountain of the apparatus according to the invention is preferably an ink fountain of this type with metering slides or metering tongues or metering levers as metering elements.

In accordance with another feature of the invention, the deflection line of the ink fountain roller is convex with regard to the ink fountain. The axial or longitudinal deflection line of the ink fountain roller extends in a curved manner toward the ink fountain. That outer contour line of the ink fountain roller which faces the ink fountain is preferably curved in the same direction as the outer contour line, which faces the ink fountain roller, of the ink fountain which is likewise deflected under the action of operating forces. An optimum adaptation can be achieved, in which the two outer contour lines extend parallel to one another or equidistantly to one another substantially over their entire length, with the result that the gap which is formed by the two outer contour lines has one and the same gap width substantially over its entire length. The outer contour line of the ink fountain, which outer contour line extends parallel to the outer contour line of the ink fountain roller, can be formed by the metering edges of metering elements of the ink fountain which are disposed in a row. The curvatures of the ink fountain roller and the ink fountain generated by the deflection are reversible and decrease when the holding and operating forces fall away.

In accordance with a further feature of the invention, the ink fountain has first supporting rollers, through which the ink fountain is supported on the ink fountain roller if the ink fountain is set against the ink fountain roller. The first supporting rollers can include only two first supporting rollers, of which one rolls on a roller raceway close to one end of a body or barrel of the ink fountain roller, on the body, and the other rolls on a roller raceway close to the other end of the body, on the body. However, the first supporting rollers can also include more than two first supporting rollers, for example two supporting roller pairs. Independently of the number of the first supporting rollers, their supporting roller raceways which are provided on the body of the ink fountain roller are situated outside the maximum printing width of the printing press, with the result that the first supporting rollers cannot cause any disruptions in the printed image. As a result of the first supporting rollers, the deflection length which is relevant for the metering gap advantageously results from the spacing between the first supporting rollers. Furthermore, an automatic compensation takes place of roundness faults of the ink fountain roller and of thermally induced changes in the spacing between the geometric rotational axis of the ink fountain roller and the geometric rotational axis of a joint of the ink fountain.

In accordance with an added feature of the invention, second supporting rollers, which are spring-loaded, are disposed diametrically with respect to the first supporting rollers. The springs which are used for the spring loading of the second supporting rollers can, for example, be helical springs, disk springs or other elastic elements. The second supporting rollers can include only two second supporting rollers which in each case roll individually close to the respective end of the body of the ink fountain roller, on the body, and can also include more than two second supporting rollers, for example two supporting roller pairs. The second supporting rollers can be disposed so as to be substantially flush with the first supporting rollers in the circumferential direction of the ink fountain roller and can roll on the same roller raceways as the first supporting rollers. The second supporting rollers are advantageous with regard to an increase in the rigidity and a minimization of the bearing play of the ink fountain roller.

In accordance with an additional feature of the invention, a metering gap lies substantially on an imaginary connecting line which extends from the first supporting rollers to the second supporting rollers. The metering gap is formed by the metering elements together with the ink fountain roller. The common contact point which the first supporting rollers form together with the ink fountain roller and the common contact point which the second supporting rollers form together with the ink fountain roller, preferably lie substantially on one and the same connecting center line. Accordingly, the two contact points and the geometric rotational axis of the ink fountain roller are disposed collinearly.

In accordance with yet another feature of the invention, the at least one elastic element is formed by springs, by which the ink fountain is loaded. The springs can be compression springs or tensile springs which press or pull the ink fountain with the first supporting rollers against the ink fountain roller. The two last-mentioned developments are advantageous in the following respect: the force which is exerted by the first supporting rollers on the ink fountain roller and the force which is exerted by the second supporting rollers on the ink fountain roller are directed substantially counter to one another and, due to the explained supporting roller positioning, together form a resulting force, the main component of which is directed in the direction of the force which is exerted by the first supporting rollers on the ink fountain roller, but is smaller than the latter, as a result of which bearing relief of the ink applicator roller is achieved.

In accordance with yet a further feature of the invention, the ink fountain is supported on frame-side stops if the ink fountain is set against the ink fountain roller. The frame-side stops are disposed on a main or auxiliary frame of the printing press and thus not on the ink fountain roller. As a result of the adjustment of the ink fountain toward the ink fountain roller, the ink fountain comes into contact with the stops, of which one is disposed on the operating side of the printing press and the other is disposed on the drive side.

In accordance with yet an added feature of the invention, the ink fountain is held on the stops by a pliant drawing device or traction mechanism or devices which wraps or wrap around the bearing rings of the ink fountain roller. The pliant drawing device or traction mechanism can be a flexible drawing device or traction mechanism, such as cables, bands and belts, or multiple-link drawing devices or traction mechanisms, such as chains. The bearing rings are mounted on journals of the ink fountain roller and are substantially flush with the stops, that is to say there is no offset or only a low offset in the direction parallel to the rotational axis of the ink fountain roller between the bearing ring and the stop on the respective machine side (the drive side or the operating side).

In accordance with yet an additional feature of the invention, the at least one elastic element is formed by springs, by which the drawing device or traction mechanism or devices is or are loaded. The springs are tensile springs, for example tensile springs which are configured as helical springs, and are attached in each case with their one spring end to a drawing device or traction mechanism end of the respective drawing device or traction mechanism and with their other spring end to a basic body of the ink fountain. The other drawing device or traction mechanism ends, to which the springs are not attached, are attached to the basic body. The springs are under prestress if the ink fountain is set against the ink fountain roller. One advantage includes the fact that, if the springs are used, the drawing device or traction mechanism can be non-elastic and can, for example, be wire cables.

In accordance with again another feature of the invention, the drawing device or traction mechanism is inherently flexible and forms the at least one elastic element, and over-center tensioning mechanisms are provided which have a dead center position for tensioning the drawing device or traction mechanism. In this development, the drawing devices or traction mechanisms can be extended reversibly and can, for example, be rubber bands. The over-center tensioning mechanisms in each case include a tensioning lever, to which the end of the respective drawing device or traction mechanism is attached. It is advantageous that, as a result of the integration of the spring function into the drawing device or traction mechanism, no separate springs are required for this function, with the result that production costs are reduced.

In accordance with again a further feature of the invention, the ink fountain is mounted in such a way that it can be adjusted about a rotary joint relative to the ink fountain roller. The ink fountain is pivoted around the rotary joint, in order to adjust the ink fountain toward the ink fountain roller into the mentioned operating position and away from the ink fountain roller into the likewise mentioned maintenance position.

With the objects of the invention in view, there is concomitantly provided a printing press, comprising an apparatus according to the invention or an apparatus which corresponds to one of the developments thereof mentioned above.

Other features which are considered as characteristic for the invention are set forth in the appended claims.

Although the invention is illustrated and described herein as embodied in an apparatus for metering printing ink and a printing press having the apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
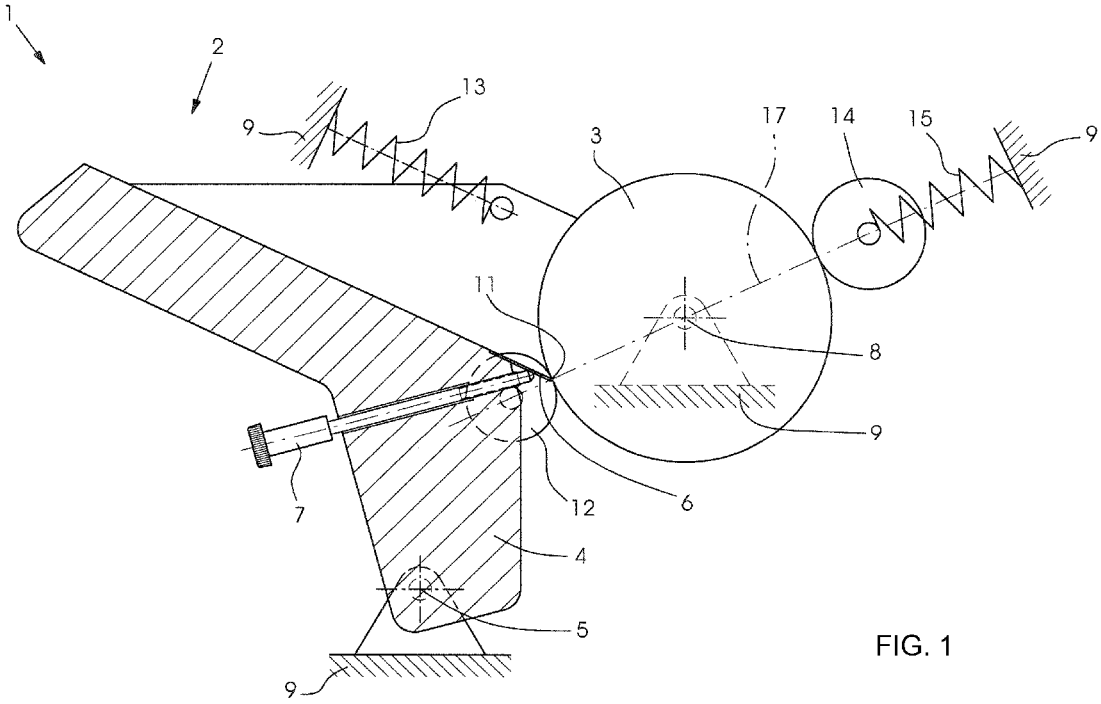
FIG. 1 is a diagrammatic, cross-sectional view of a first exemplary embodiment of the invention, with an ink fountain which is supported on an ink fountain roller by supporting rollers.
Figure 2:
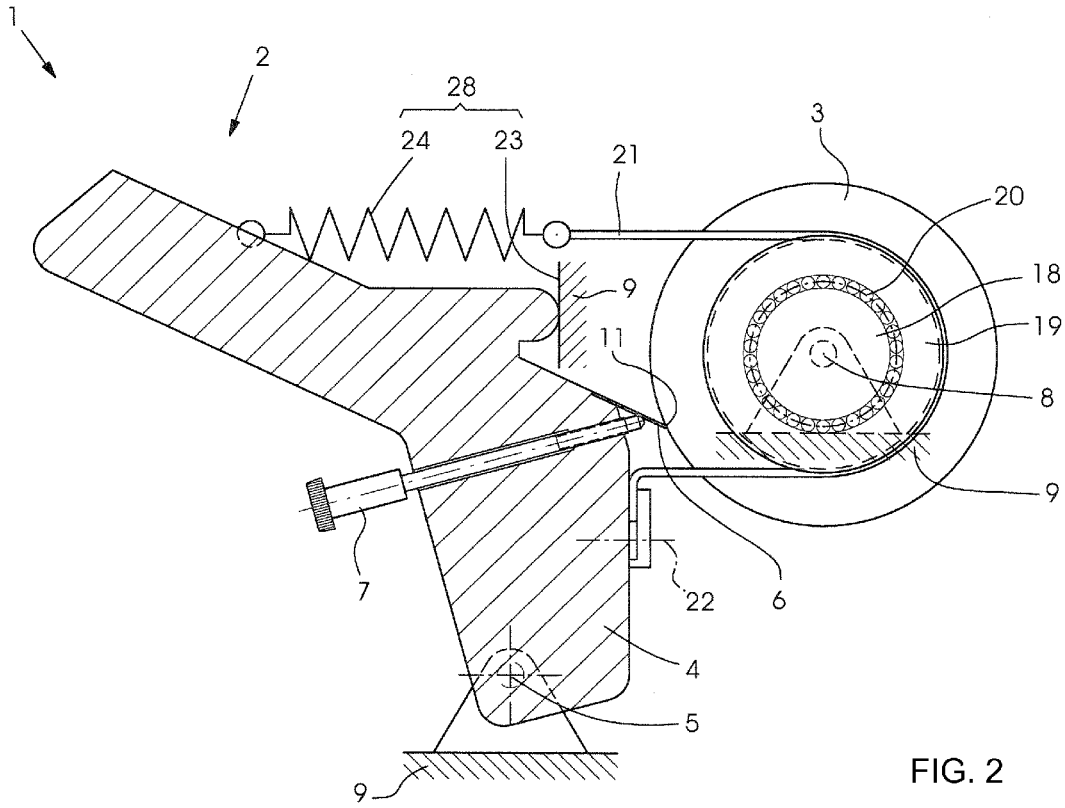
FIG. 2 is a view similar to FIG. 1 of a second exemplary embodiment with an ink fountain which is held on the ink fountain roller by a drawing device or traction mechanism which is resilient.
Figure 3:
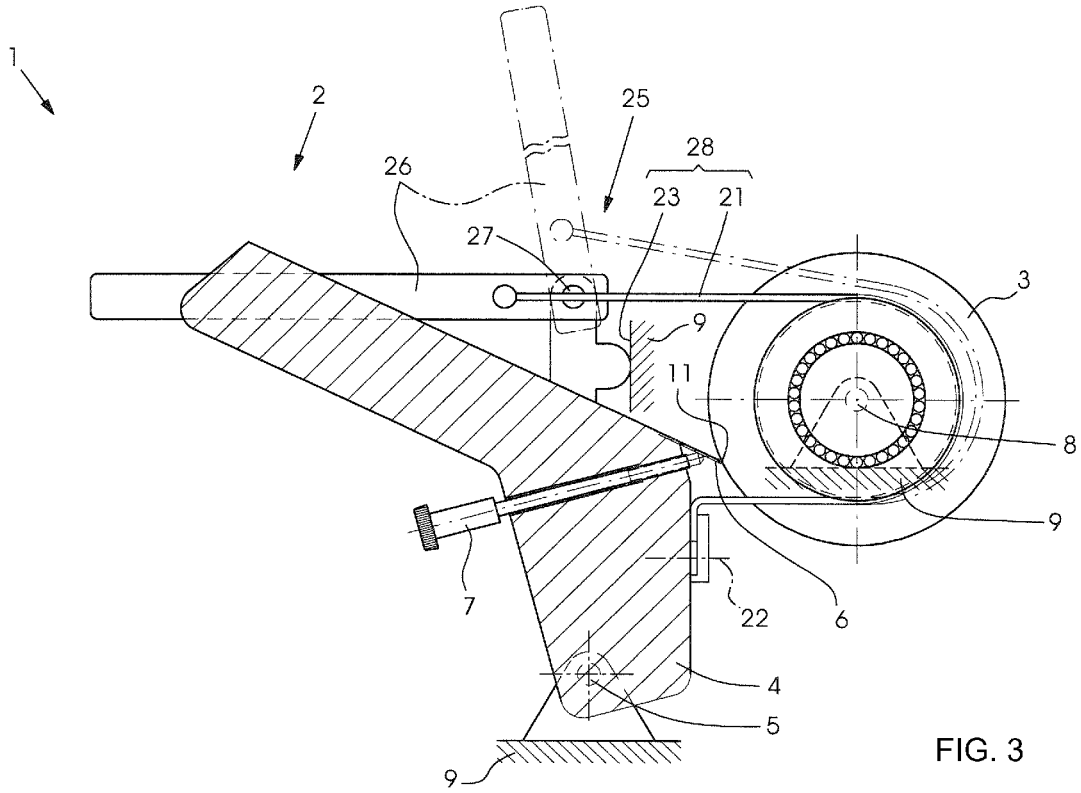
FIG. 3 is a view similar to FIGS. 1 and 2 of a third exemplary embodiment with an ink fountain which is held on the ink fountain roller by a drawing device or traction mechanism which is prestressed by over-center tensioning mechanisms.

Referring now in detail to the figures of the drawings, in which mutually corresponding elements and components are denoted by the same designations and first, particularly, to FIGS. 1 to 3 thereof, there is seen, in each case, a printing press 1 having an inking unit 2. The printing press 1 is a lithographic offset printing press for printing sheets.

The figures show an ink fountain roller 3 and an ink fountain 4 of the inking unit 2. Furthermore, the inking unit 2 includes ink applicator rollers which roll on a printing form, axially moving distributor rollers and transfer rollers, which are all not shown in the drawing. If the inking unit 2 is a ductor inking unit, it includes a ductor roller which periodically comes into contact with the ink fountain roller 3, and if the inking unit 2 is a film inking unit, it includes a film roller which removes printing ink from the ink fountain roller 3 and the circumferential speed of which corresponds substantially to the circumferential speed of the printing form.

The ink fountain 4 is a so-called wedge-shaped ink fountain and can be pivoted about a rotary joint 5 which is parallel to the rotational axis of the ink fountain roller 3. The ink fountain 4 includes metering elements 6 which are disposed in a row that is parallel to the ink fountain roller 3. The metering elements can be adjusted with respect to one another through the use of so-called zone screws 7 and can be adjusted in the process to different spacings from the ink fountain roller 3, in order to generate an inking profile on the latter with ink layers of different thickness in the individual inking zones. The metering elements 6 can be metering slides or metering levers or metering tongues which are formed on one and the same metering blade. A configuration of the metering elements 6 as metering tongues which are separate from one another is shown in the drawing by way of example. The ink fountain roller 3 is mounted through a pivot bearing 8 in a frame 9 which has a respective side wall 10 shown in FIG. 4 on each of a drive side and an operating side of the printing press. None of the metering elements 6 also touches the circumferential surface of the ink fountain roller 3 in the operating position of the ink fountain 4, in which the ink fountain 4 is pivoted toward the ink fountain roller 3. Those metering elements 6 which are adjusted the furthest toward the ink fountain roller 3, that is to say the metering elements in the inking zones with the minimum ink requirement, also do not touch the ink fountain roller 3 and, in the region of a metering gap 11, are at a spacing from the ink fountain roller 3 of approximately 5 micrometers.

Now that the common features of the different exemplary embodiments have been described together in the above text, the special features of the respective exemplary embodiments will be described in the following text. In the first exemplary embodiment which is shown in FIGS. 1 and 4 to 6, one respective first supporting roller 12 is attached to the ink fountain 4 on each of the drive side and the operating side of the printing press 1. It can be seen in FIG. 4 that the first supporting rollers 12 are situated outside a maximum printing width which corresponds to a length of the row of the metering elements 6. The ink fountain 4 is loaded by first springs 13 which are each supported with one spring end thereof on the frame 9 and with the other spring end thereof on the ink fountain, for example on a lateral ink fountain cheek or a transverse pin which is seated therein. The springs 13 attempt to pivot the ink fountain 4 around the rotary joint 5 in such a way that the first supporting rollers 12 are pressed against the circumferential surface of the ink fountain roller 3. On that side of the ink fountain roller 3 which lies opposite the first supporting rollers 12, second supporting rollers 14 bear against the ink fountain roller 3. The second supporting rollers 14 are pressed by second springs 15 against the ink fountain roller 3. The second springs 15, which are compression springs just like the first springs 13, are supported in each case with one spring end thereof on the frame 9 and with the other spring end thereof on an axle of the second supporting roller 14. It can be seen clearly in FIG. 4 that the second supporting rollers 14 are situated outside the maximum printing width and are flush with the first supporting rollers 12 in the circumferential direction of the ink fountain roller 3. Common raceways 16 of the supporting rollers 12, 14 are indicated by phantom lines. It can be seen in FIG. 1 that a common tangential point of the first supporting rollers 12 and the ink fountain roller 3 and a common tangential point of the second supporting rollers 14 and the ink fountain roller 3 and a geometric rotational axis of the ink fountain roller 3, lie on a common connecting center line 17, on which the metering gap 11 likewise lies.

In the following text, common features of the second exemplary embodiment which is shown in FIG. 2 and the third exemplary embodiment which is shown in FIG. 3, will be described together.

In the exemplary embodiments according to FIGS. 2 and 3, one bearing ring 19 is seated on each respective axle journal 18 of the ink fountain roller 3. The two bearing rings 19 are mounted on the axle journals 18 through pivot bearings 20, preferably antifriction bearings, and a respective drawing device or traction mechanism 21 is wrapped around each bearing ring 19. The drawing devices or traction mechanisms 21 can be cables or belts. One circumferential groove, which guides the respective drawing device or traction mechanism 21, is formed in each respective bearing ring 19. One end of each respective drawing device or traction mechanism 21 is fastened to the ink fountain 4 or its basic body, for example by configuring an end of the drawing device or traction mechanism as a socket or a grommet, through which a fastening pin or a fastening screw 22 is plugged, as indicated in the drawing by a center line. A device pulls at the other end of the respective drawing device or traction mechanism 21. The configurations of the exemplary embodiments shown in FIGS. 2 and 3 differ from one another with regard to the pulling device. These two different configurations will be described later in detail. In both exemplary embodiments, the ink fountain 4 bears against a stop 23 in its operating position, in which it is pivoted toward the ink fountain roller. The stop 23 defines the operating position of the ink fountain 4 relative to the ink fountain roller 3. The stop 23 is provided in a double configuration, once on the drive side and a further time on the operating side of the printing press 1. The respective stop 23 can be formed by a surface of the frame 9 or of a component which is attached thereto. In the operating position of the ink fountain 4, the latter bears with spherical projections against the stops 23. It is possible for the spherical projections to be formed integrally on or in one piece with the basic body of the ink fountain 3 or on a component which is fastened to the basic body. The two stops 23 are situated outside the printing width, with the operating-side stop 23 being substantially flush with the operating-side bearing ring 19 and the drive-side stop 23 being substantially flush with the drive-side bearing ring 19, as viewed in a direction parallel to the plane of the drawing of FIGS. 2 and 3.

One special feature of the apparatus shown in FIG. 2 includes a configuration of the mechanism which tensions the drawing device or traction mechanism 21 in the form of two springs 24. Each of the two springs 24 is fastened with one spring end thereof to the end of the respective drawing device or traction mechanism 21 and is fastened with the other spring end thereof to the ink fountain 4. The springs 24, which can be subjected to a tensile load, are under prestress if the ink fountain 4 is situated in its operating position which is shown in the drawing, and in the process tighten the drawing device or traction mechanism 21. As a result of the use of the springs 24, the ink fountain 4 is pivoted around the rotary joint 5 and is pressed against the stops 23. According to modifications which are not shown in greater detail in the drawing, it would be possible to fasten one of the two ends (that end of the drawing device or traction mechanism 21 which is fastened to the ink fountain 4 through the use of the fastening screw 22 or that end of the spring 24 which is fastened to the ink fountain 4) to the frame 9 instead of to the ink fountain 4. There can be provision for it to be possible for one of the two ends mentioned to be released without tools by the machine operator from the ink fountain 4 or, in the alternative embodiment, from the frame 9, in order for it to be possible to pivot the ink fountain 4 more easily out of its operating position into a maintenance position which is spaced further apart from the ink fountain roller 3.

One special feature of the apparatus shown in FIG. 3 includes a mechanism which tensions the drawing device or traction mechanism 21 that is configured in the form of over-center tensioning mechanisms 25. Each of the two over-center tensioning mechanisms 25 includes a pivotably mounted tensioning lever 26, to which one end of the respective drawing device or traction mechanism 21 is attached. A phantom line shows a respective tensioning lever 26 and a respective drawing device or traction mechanism 21, in a position in which the drawing device or traction mechanism 21 is not yet under prestress. During the pivoting of the tensioning levers 26, which takes place in a counterclockwise direction with regard to FIG. 3, the drawing devices or traction mechanisms 21 are tightened increasingly and set under prestress. The solid line shows a position which is a so-called dead center position and in which the respective over-center tensioning mechanism snaps over. In this dead center position, the drawing device or traction mechanism 21 has reached its maximum prestress, and the longitudinal axis of the tensioning lever 26 and the longitudinal axis of that run of the drawing device or traction mechanism 21 which is fastened to the tensioning lever 26, are flush with one another. In the dead center position, the drawing device or traction mechanism 21 overlaps a rotary joint 27, about which the tensioning lever 26 can be pivoted. The dead center is an indifferent position, in which the tensioning lever 26 can snap over or tilt in or counter to the clockwise direction. The respective tensioning lever 26 is therefore moved a few angular degrees more counter to the clockwise direction beyond the dead center position, until the tensioning lever 26 bears against a stop (not shown in the drawing). As a result of the prestress of the drawing device or traction mechanism 21, the tensioning lever 26 is held in contact with the stop, with the drawing device or traction mechanism 21 no longer extending through the geometric rotational axis of the rotary joint 27 in this case.

Figure 4:
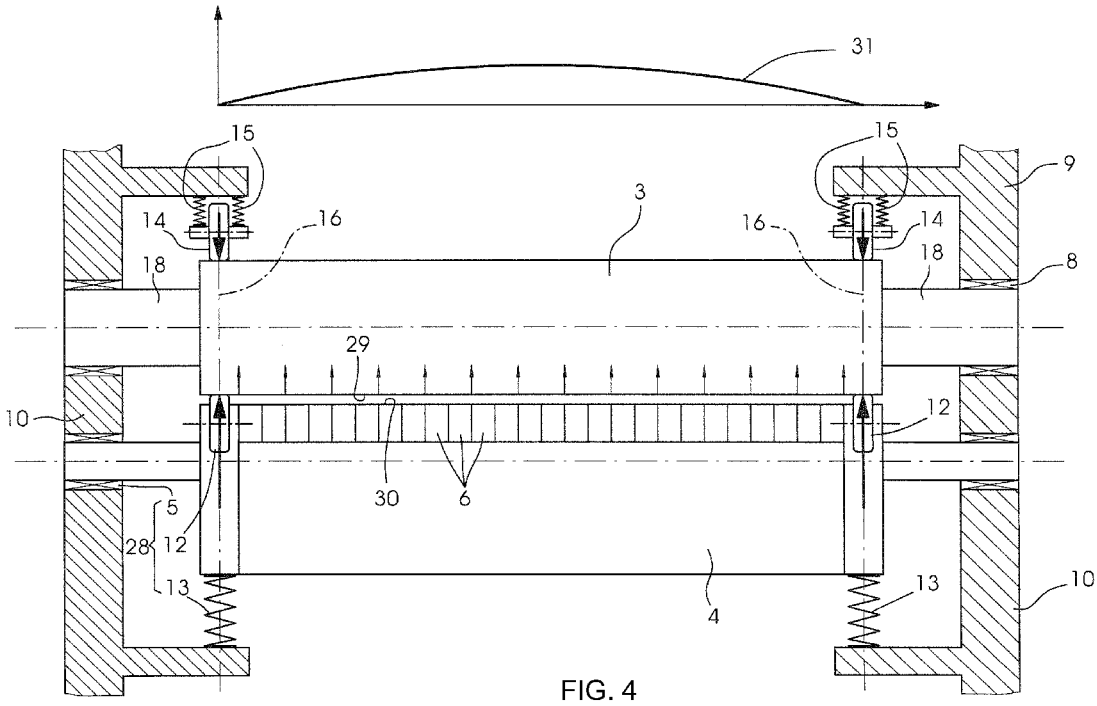
FIG. 4 is a fragmentary, partly-sectional plan view showing a concave deflection line profile of the ink fountain roller using the example of the apparatus of FIG. 1.

FIG. 4 shows both a plan view of the apparatus of FIG. 1 and a corresponding diagram. In the plan view, the zone screws 7 are omitted for reasons of improved clarity. It is shown that, inter alia, the rotary joint 5, the first supporting rollers 12 and the first springs 13 are constituent parts of a mounting 28 of the ink fountain 4. The mounting 28 is provided overall in such a way that the course of an outer contour 29 of the ink fountain roller 3 is adapted to the course of an outer contour 30 of the ink fountain 4. In the ideal case, the outer contour 29 of the ink fountain roller 3 runs parallel with the outer contour 30 of the ink fountain 4. The diagram shows an elastic, bending or deflection line 31 of the ink fountain roller 3, with the abscissa specifying the location of the deflection and the ordinate specifying the extent of the deflection. The scale of the abscissa corresponds to the scale of the plan view of the apparatus depicted below it. In contrast, the extent of the deflection is shown in an exaggerated manner. The deflection line 31 specified in FIG. 4 is concave, that is to say the deflection line 31 extends in a manner which curves away from the ink fountain 4. The outer contour 29 also extends correspondingly, but cannot be seen in FIG. 4 for reasons of illustrative simplicity. Due to the parallelism between the outer contours 29 and 30, the outer contour 30 of the ink fountain 4 extends in a manner that is curved toward the ink fountain roller 3, which likewise cannot be seen in FIG. 4 for reasons of illustrative simplicity. In FIG. 4, the setting or bearing forces which cause the profile of the deflection line 31 are shown symbolically by large arrows, and the operating forces which are transmitted through the printing ink onto the ink fountain roller 3 are shown symbolically by small arrows. The bearing forces are transmitted through the rollers 12, 14 to the ink fountain roller 3. That outer contour 30 of the ink fountain 4 which is formed by metering edges of the metering elements 6 presses on the ink fountain roller 3 through the printing ink which is situated in the metering gap 11 between this outer contour 30 of the ink fountain 4 and the outer contour 29 of the ink fountain roller 3, and in the process generates the operating forces.

Figure 5:
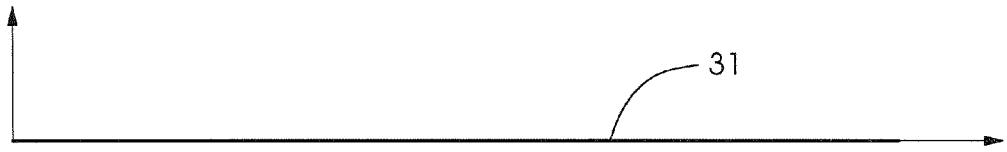
FIG. 5 is a graph showing a linear deflection line profile of the ink fountain roller using the example of the apparatus of FIG. 1.

However, the mounting 28 can also be configured in such a way that the deflection line 31 extends linearly, as is specified in the diagram according to FIG. 5. In this case, the diagram according to FIG. 5 would take the place of the diagram in FIG. 4. In the case of the linear course of the deflection line 31, the two outer contours 29, 30 which extend parallel to one another would also in each case extend linearly.

Figure 6:
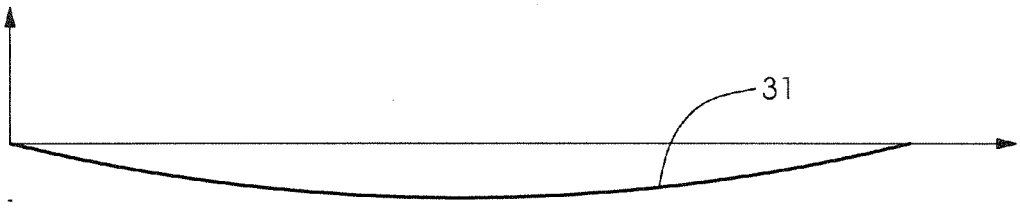
FIG. 6 is a graph showing a convex deflection line profile of the ink fountain roller using the example of the apparatus of FIG. 1.

FIG. 6 shows a further possibility of the course of the deflection line 31. In this case, the deflection line 31 of the ink fountain roller 3 extends in a convexly curved manner, that is to say in a manner which is curved toward the ink fountain 4. Accordingly, the outer contour 29 of the ink fountain roller 3 likewise extends in a manner which is curved toward the ink fountain 4, and the outer contour 30 of the ink fountain 4 extends in a manner which is curved away from the ink fountain roller 3, with the two outer contours 29, 30 also extending parallel to one another in this case. That course of the deflection line 31, which is shown in FIG. 6, is the preferred variant.

Finally, it is to be noted that, although the ideal case (shown in the drawing) of the parallelism of the two outer contours 29, 30 with one another is to be aimed for, it is not achieved completely in one or the other application. However, the invention also has an advantageous effect in those cases, in which the magnitude of the deviation from the parallelism of the two contour courses with one another is reduced by the adaptation of the course of the outer contour 29 of the ink fountain roller 3 to the course of the outer contour 30 of the ink fountain 4.

The invention claimed is:

1. A printing press comprising:

a frame;

an apparatus for metering printing ink, the apparatus including:

an ink fountain roller having a circumferential surface and a longitudinal outer contour;

an ink fountain having a longitudinal outer contour, a row of metering elements and first supporting rollers supporting said ink fountain on said ink fountain roller when said ink fountain is set against said ink fountain roller;

a mounting for said ink fountain, said mounting permitting an adjustment of said ink fountain relative to said ink fountain roller, said ink fountain being mounted for adjustment relative to said ink fountain roller about a rotary joint into an operating position, none of said metering elements touching said circumferential surface in the operating position;

said mounting having at least one elastic element for generating a holding force, said at least one elastic element being formed by first springs loading said ink fountain, said first springs being supported with one end on said frame and an opposite end thereof on said ink fountain, said first springs being disposed for attempting to pivot said ink fountain about said rotary joint so that said first supporting rollers are pressed against said circumferential surface of said ink fountain roller; and said mounting being configured to cause a force flux resulting from said holding force to deflect said ink fountain roller for adapting said longitudinal outer contour of said ink fountain roller to said longitudinal outer contour of said ink fountain;

second, spring-loaded supporting rollers disposed diametrically relative to said first supporting rollers, said second supporting rollers being spring-loaded by second springs for pressing said second supporting rollers against said ink fountain roller;

said first supporting rollers and said second supporting rollers defining an imaginary connecting line extending therebetween and a metering gap lying substantially on said imaginary connecting line.

2. The printing press according to claim 1, wherein said ink fountain roller has a deflection line being convex relative to said ink fountain.

* * * * *